US007283906B1

(12) United States Patent
Gearhart

(10) Patent No.: US 7,283,906 B1
(45) **Date of Patent: *Oct. 16, 2007**

(54) PRESENTING DRIVING DIRECTIONS

(75) Inventor: Duane G. Gearhart, Hummelstown, PA (US)

(73) Assignee: AOL LLC, Dulles, VA (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/424,013

(22) Filed: Jun. 14, 2006

Related U.S. Application Data

(63) Continuation of application No. 10/674,822, filed on Oct. 1, 2003, now Pat. No. 7,065,448.

(51) Int. Cl.
*G08G 1/123* (2006.01)

(52) U.S. Cl. ..... 701/211; 340/995.14; 340/995.2

(58) Field of Classification Search ..... 701/200–213; 340/988–995.27

See application file for complete search history.

(56) References Cited

U.S. PATENT DOCUMENTS

| | | | |
|---|---|---|---|
| 5,311,173 | A | 5/1994 | Komura et al. |
| 5,504,482 | A | 4/1996 | Schreder |
| 5,508,930 | A | 4/1996 | Smith, Jr. |
| 5,513,110 | A | 4/1996 | Fujita et al. |
| 5,752,217 | A | 5/1998 | Ishizaki et al. |
| 5,802,492 | A | 9/1998 | DeLorme et al. |
| 5,935,193 | A | 8/1999 | Saiki |
| 5,938,720 | A | 8/1999 | Tamai |
| 5,948,040 | A | 9/1999 | DeLorme et al. |
| 6,049,753 | A | 4/2000 | Nimura |
| 6,085,147 | A | 7/2000 | Myers |
| 6,172,641 | B1 | 1/2001 | Millington |
| 6,338,021 | B1 | 1/2002 | Yagyu et al. |
| 6,349,261 | B1 | 2/2002 | Ohnishi et al. |
| 6,351,707 | B1 | 2/2002 | Ichikawa |
| 6,356,911 | B1 | 3/2002 | Shibuya |
| 6,363,322 | B1 | 3/2002 | Millington |
| 6,577,937 | B1 | 6/2003 | Shuman et al. |
| 6,771,189 | B2 | 8/2004 | Yokota |
| 2001/0021895 | A1 | 9/2001 | Yamazaki |
| 2001/0047241 | A1 | 11/2001 | Khavath et al. |
| 2002/0011941 | A1 | 1/2002 | Endo et al. |
| 2002/0067728 | A1 | 6/2002 | Okamoto |
| 2002/0077745 | A1 | 6/2002 | Ohmura et al. |

FOREIGN PATENT DOCUMENTS

| | | |
|---|---|---|
| WO | WO 00/22593 | 4/2000 |

OTHER PUBLICATIONS

"Streets & Tips 2004, Using Streets & Trips"; http://www.microsoft.com/streets/webcomparison/default.asp; 1 page; (Jul. 3, 2004).

"Streets & Tips 2004, Preferences"; http://www.microsoft.com/streets/useit/preferences.asp; 1 page; (Jul. 3, 2004).

(Continued)

*Primary Examiner*—Richard M. Camby
(74) *Attorney, Agent, or Firm*—Fish & Richardson P.C.

(57) ABSTRACT

Techniques are provided for reducing the number of maneuvers presented in narrative driving directions for a route from an origin location to a destination location. Maneuvers are combined to reduce the number of maneuvers presented. Maneuvers may be combined based on a maneuver being associated with a highway interchange or maneuvers including a shared reference to a particular road.

29 Claims, 10 Drawing Sheets

OTHER PUBLICATIONS

"COSMI, Street Maps USA"; http://www.cosmi.com/html/product%20pages/productivity/street_maps.htm; 1 page; (Jul. 3, 2004).

"Microsoft MapPoint 2004, Fact Sheet, Sep. 2003", pp. 1-6; (Sep. 2003).

U.S. Appl. No. 11/019,550 filed Dec. 23, 2004, titled "Reducing Driving Directions".

600

610 620

| NARRATIVE TEXT FOR DRIVING MANEUVER | LINKS | |
|---|---|---|
| Start out going West on MILL RD toward Cress Rd. | 310L | 611 |
| Turn LEFT to stay on MILL RD. | 320L | 612 |
| Turn RIGHT onto JEFFERSON AVE/SR-49. Continue to follow SR-49. | 327L-330L | 613 |
| Merge onto I-95 S via exit 11B toward WASHINGTON | 335L-345L | 614 |
| Merge onto I-235 E via exit 28A toward OCEAN BEACH. | 350L | 615 |

FIG. 6

800

810

| 510 LINK | 520 COMPUTED TURN ANGLE | 540 ROAD NAME | 545 ALTERNATE ROAD NAME | 550 INTERNAL? | |
|---|---|---|---|---|---|
| 310L | | Mill Rd. | | N | 310L |
| 312L | Straight | | | Y | 312L |
| 314L | Left | | | Y | 314L |
| 320L | Straight | Mill Rd. | | N | 320L |
| 327L | Right | Jefferson Ave | SR-49 | N | 327L |
| 330L | Straight | Monroe Ave | SR-49 | N | 330L |

ELIMINATE INTERNAL LINKS — 420

CHECK ROAD NAMES — 425

CREATE MANEUVER — 430

820

| 825 LINK | 830 COMPUTED TURN ANGLE | 835 ROAD NAME | 840 ALTERNATE ROAD NAME | 845 FIRST MANEUVER? | |
|---|---|---|---|---|---|
| 310L-312L | Straight | Mill Rd. | | Y | 821 |
| 314L-320L | Left | Mill Rd. | | N | 822 |
| 327L-330L | Right | Jefferson Ave | SR-49 | N | 823 |

612 Turn LEFT to stay on MILL RD.

613 Turn RIGHT onto JEFFERSON AVE/ SR-49. Continue to follow SR-49.

FIG. 8

PRESENTING DRIVING DIRECTIONS

CROSS-REFERENCE TO RELATED APPLICATIONS

This application is a continuation application of U.S. application Ser. No. 10/674,822, filed Oct. 1, 2003, now allowed U.S. Pat. No. 7,065,448, and titled "Presenting Driving Directions," which is incorporated by reference in its entirety.

TECHNICAL FIELD

This description relates to presenting driving directions for a travel route between an origin location and a destination location.

BACKGROUND

A travel route between an origin location and a destination location may be determined by a computer system, which may be referred to as a mapping system. The mapping system may make this determination by searching for an optimal path through a directed graph (e.g., a collection of nodes and edges) that represents a network of roads and intersections. Each edge (or link) of the graph may represent a road in a map, and each node of the graph may represent an intersection of two or more roads or a terminal point of a road, such as a dead end road.

A user of a mapping system may want to see driving directions, which may be in the form of maneuvers in the travel route with a narrative description of each maneuver to be made. The driving directions may be difficult to comprehend, particularly while attempting to follow the driving directions and drive a vehicle at the same time. This may be particularly true when a mapping system displays a maneuver for each link in the graph that represents the route.

SUMMARY

In one general aspect, driving directions having multiple maneuvers are displayed by accessing route information for a route from an origin to a destination and generating maneuvers for the route based on the route information. A first maneuver is combined with a second maneuver based at least in part upon the first maneuver being associated with a highway interchange and the second maneuver being associated with the highway interchange, and the combined route maneuver is presented on a user system.

Implementations may include one or more of the following features. For example, additional interchange maneuvers may be identified, and redundant interchange maneuvers may be eliminated such that a particular highway or a particular interstate is only included in one interchange maneuver for the route.

The combined route maneuver may be displayed in driving directions that are displayed by a system connected to an Internet service provider, a printer or display device associated with the user system, a personal digital assistant, or a display device associated with an on-board navigation system of a vehicle.

The combined route maneuver on the user system may be presented using text that starts with "Merge onto" and includes text associated with a particular road name that is appended with "via" and an exit number associated with the combined maneuver or with "via" and exit information associated with the combined maneuver.

In another general aspect, driving directions having multiple maneuvers are displayed by accessing route information for a route from an origin to a destination and generating maneuvers for the route based on the route information. A first maneuver is combined with a second maneuver based at least in part upon the first maneuver including a reference to a particular road, and the combined route maneuver is presented on a user system.

Implementations may include one or more of the features noted above. In addition, combining a first maneuver with a second maneuver to produce a combined route maneuver may be based at least in part upon the first maneuver including a reference to a particular road unless an intersection between the first maneuver and the second maneuver includes an intersecting forward link.

Implementations of any of the techniques described may include a method or process, an apparatus or system, or computer software on a computer-accessible medium. The details of particular implementations are set forth below. Other features will be apparent from the description and drawings, and from the claims.

DESCRIPTION OF DRAWINGS

FIGS. 4, and 8-10 are diagrams illustrating a process for presenting driving directions.

FIG. 6 is a block diagram that illustrates the results of presenting driving directions.

DETAILED DESCRIPTION

Techniques are provided for reducing the number of maneuvers presented in narrative driving directions for a route from an origin location to a destination location. The techniques may help to present driving directions that more closely approximate the style of person-to-person communication of directions. For example, the techniques help to narrow the list of maneuvers to provide a list of relevant roads and a description of a maneuver related to each road. The resulting displayed narrative driving directions may be referred to as succinct driving directions.

The succinct driving directions may be closer to the way one person conveys driving directions to another person. For example, a person may indicate a turn direction (e.g., left or right turn or merge onto an interstate) and a road name. By contrast, a conventional mapping system may provide a maneuver that corresponds to each link in a route in which a road in the route is depicted by multiple links. The challenge is to identify information that is needed by a driver to follow a route, while eliminating other extraneous information.

The display of fewer maneuvers for a route may enable a user to understand the displayed travel route more quickly than when a large number of narrative driving direction maneuvers are displayed for the travel route. For example, a user may be able to quickly view nine route maneuvers to understand the state roads, highways and interstates that are included in the travel route, and, in so doing, to understand the maneuvers that are to be made to follow the travel route between the origin and destination.

Figure 1:
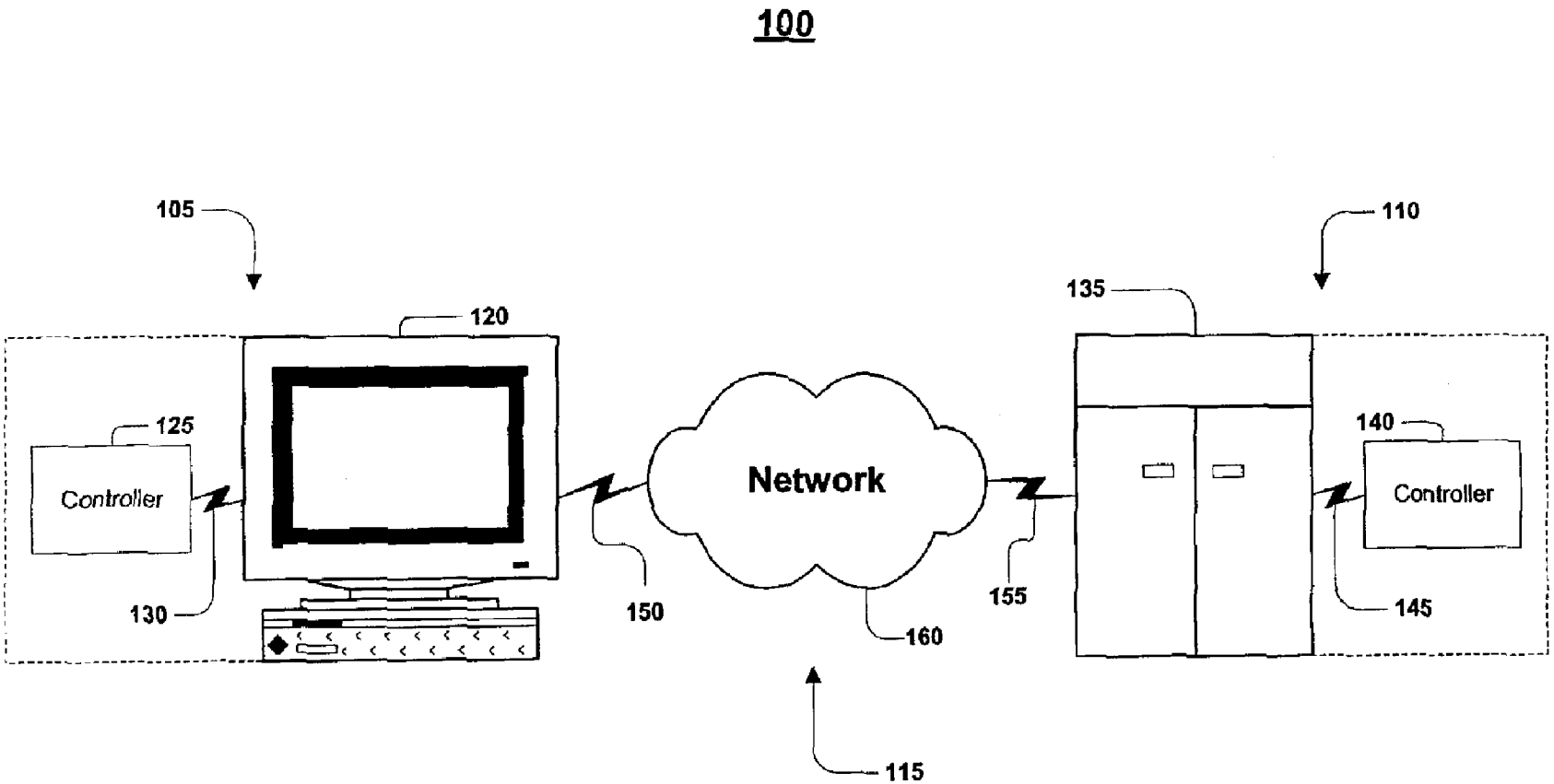
FIG. 1 is a block diagram of a communications system capable of displaying driving directions of a travel route.
Figure 2:
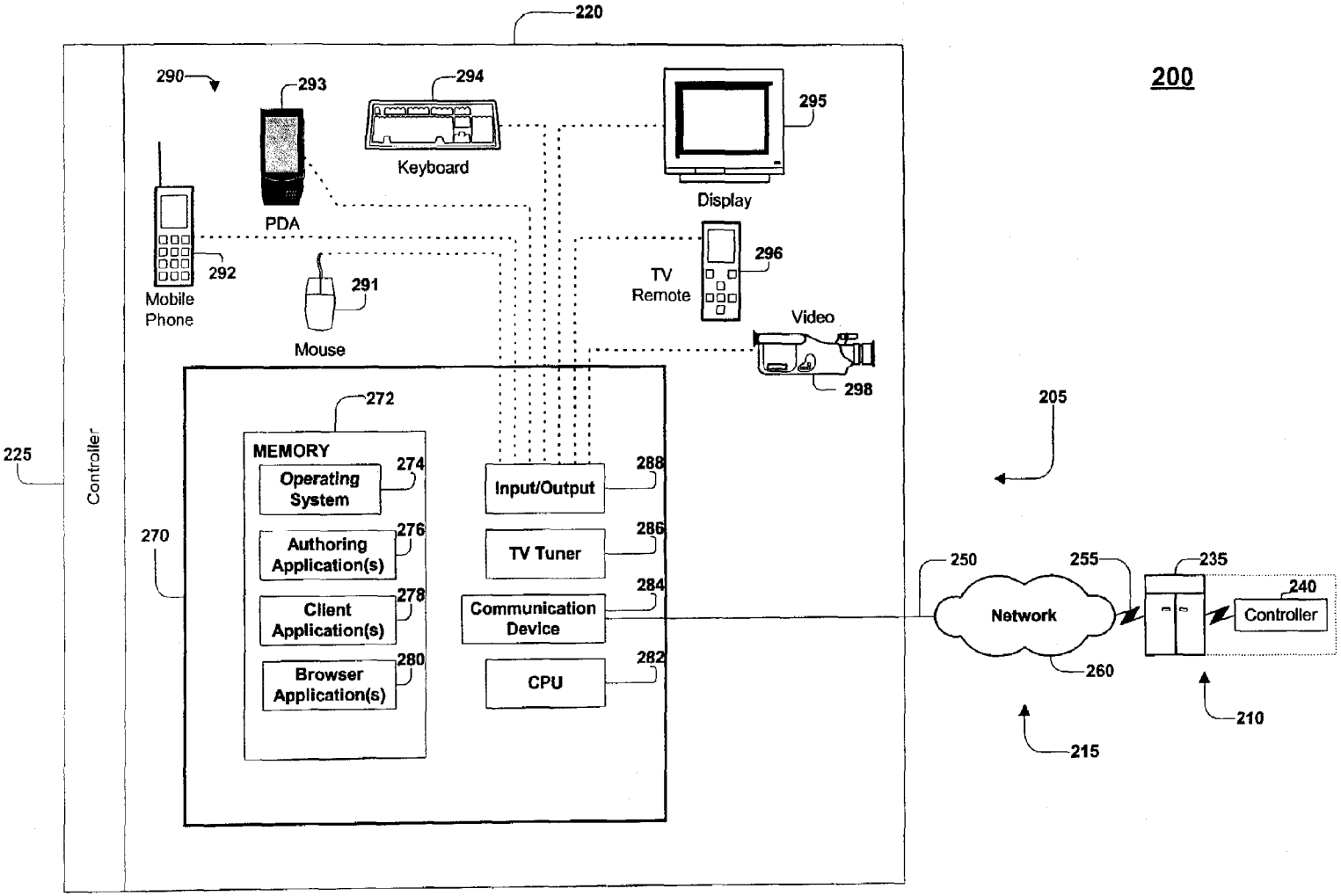
FIG. 2 is an expansion of the block diagram of FIG. 1.

For illustrative purposes, FIGS. 1 and 2 describe a communications system that may be used to request and provide routes, including driving directions, between origin and destination locations. For brevity, several elements in the figures described below are represented as monolithic entities. However, as would be understood by one skilled in the art, these elements each may include numerous interconnected computers and components designed to perform a set of specified operations and/or dedicated to a particular geographic region.

Referring to FIG. 1, a communications system 100 is capable of delivering and exchanging data between a client system 105 and a host system 110 through a communications link 115. The client system 105 typically includes one or more client devices 120 and/or client controllers 125, and the host system 110 typically includes one or more host devices 135 and/or host controllers 140. For example, the client system 105 or the host system 110 may include one or more general-purpose computers (e.g., personal computers), one or more special-purpose computers (e.g., devices specifically programmed to communicate with each other and/or the client system 105 or the host system 110), or a combination of one or more general-purpose computers and one or more special-purpose computers. The client system 105 and the host system 110 may be arranged to operate within or in concert with one or more other systems, such as, for example, one or more LANs ("Local Area Networks") and/or one or more WANs ("Wide Area Networks").

The client device 120 (or the host device 135) is generally capable of executing instructions under the command of a client controller 125 (or a host controller 140). The client device 120 (or the host device 135) is connected to the client controller 125 (or the host controller 140) by a wired pathway 150 or 155, a wireless data pathway 150 or 155 capable of delivering data, or, when the client controller 125 (or host controller 140) is a software application loaded on the client device 120 (or the host controller 140), a virtual pathway.

Each of the client device 120, the client controller 125, the host device 135, and the host controller 140 typically includes one or more hardware components and/or software components. An example of a client device 120 or a host device 135 is a general-purpose computer (e.g., a personal computer) capable of responding to and executing instructions in a defined manner. Other examples include a special-purpose computer, a workstation, a server, a device, a component, other physical or virtual equipment or some combination thereof capable of responding to and executing instructions.

An example of the client controller 125 or the host controller 140 is a software application loaded on the client device 120 or the host device 135 for commanding and directing communications enabled by the client device 120 or the host device 135. Other examples include a program, a piece of code, an instruction, a device, a computer, a computer system, or a combination thereof, for independently or collectively instructing the client device 120 or the host device 135 to interact and operate as described. The client controller 125 and the host controller 140 may be embodied permanently or temporarily in any type of machine, component, physical or virtual equipment, storage medium, or propagated signal capable of providing instructions to the client device 120 or the host device 135.

The communications link 115 typically includes a delivery network 160 that provides a direct or indirect communication link between the client system 105 and the host system 110, irrespective of physical separation. Examples of a delivery network 160 include the Internet, the World Wide Web, WANs, LANs, analog or digital wired and wireless telephone networks (e.g., PSTN ("Public Switched Telephone Network"), ISDN ("Integrated Services Digital Network"), and DSL ("Digital Subscriber Line") including various forms of DSL such as SDSL ("Single-line Digital Subscriber Line"), ADSL ("Asymmetric Digital Subscriber Loop), HDSL ("High bit-rate Digital Subscriber Line"), and VDSL ("Very high bit-rate Digital Subscriber Line)), radio, television, cable, satellite, and/or any other delivery mechanism for carrying data. The communications link 115 may include communication pathways 150 and 155 that enable communications through the one or more delivery networks 160 described above. Each of the communication pathways 150 and 155 may include, for example, a wired, wireless, virtual, cable or satellite communications pathway.

FIG. 2 illustrates a communications system 200 including a client system 205 communicating with a host system 210 through a communications link 215. The client system 205 typically includes one or more client devices 220 and one or more client controllers 225 for controlling the client devices 220. The host system 210 typically includes one or more host devices 235 and one or more host controllers 240 for controlling the host devices 235. The communications link 215 may include communications pathways 250 and 255 that enable communications through the one or more delivery networks 260.

Examples of each element within the communication system of FIG. 2 are broadly described above with respect to FIG. 1. In particular, the host system 210 and the communications link 215 typically have attributes comparable to those described with respect to the host system 110 and the communications link 115 of FIG. 1, respectively. Likewise, the client system 205 of FIG. 2 typically has attributes comparable to, and may illustrate one possible implementation of, the client system 105 of FIG. 1.

The client device 220 typically includes a general purpose computer 270 having an internal or external storage 272 for storing data and programs such as an operating system 274 (e.g., DOS, Windows®, Windows® 95, Windows® 98, Windows® 2000, Windows® NT, Windows® Millennium Edition, Windows® XP, OS/2, or Linux) and one or more application programs. Examples of application programs include authoring applications 276 (e.g., word processing programs, database programs, spreadsheet programs, presentation programs, and graphics programs) capable of generating documents or other electronic content; client applications 278 (e.g., AOL ("America Online") client, CompuServe client, AIM ("America Online Instant Messenger") client, AOL TV ("America Online Television") client, and an ISP ("Internet Service Provider") client) capable of communicating with other computer users, accessing various computer resources, and viewing, creating, or otherwise manipulating electronic content; and browser applications 280 (e.g., Netscape's Navigator and Microsoft's Internet Explorer) capable of rendering standard Internet content.

The general-purpose computer 270 also includes a central processing unit 282 (CPU) for executing instructions in response to commands from the client controller 225. In one implementation, the client controller 225 includes one or more of the application programs installed on the internal or external storage 272 of the general-purpose computer 270. In another implementation, the client controller 225 includes application programs externally stored in and executed by one or more device(s) external to the general-purpose computer 270.

The general-purpose computer 270 typically includes a communication device 284 for sending and receiving data. One example of the communication device 284 is a modem. Other examples include a transceiver, a set-top box, a communication card, a satellite dish, an antenna, or another network adapter capable of transmitting and receiving data over the communications link 215 through a wired or wireless data pathway 250. The general-purpose computer 270 also may include a TV ("television") tuner 286 for receiving television programming in the form of broadcast, satellite, and/or cable TV signals. As a result, the client device 220 can selectively and/or simultaneously display network content received by the communications device 284 and television programming content received by the TV tuner 286.

The general-purpose computer 270 typically includes an input/output interface 288 to enable a wired or wireless connection to various peripheral devices 290. Examples of peripheral devices 290 include, but are not limited to, a mouse 291, a mobile phone 292, a personal digital assistant (PDA) 293, a keyboard 294, a display monitor 295 with or without a touch screen input, and/or a TV remote control 296 for receiving information from and rendering information to subscribers. Other examples may include voice recognition and synthesis devices.

Although FIG. 2 illustrates devices such as a mobile telephone 292, a PDA 293, and a TV remote control 296 as being peripheral with respect to the general-purpose computer 270, in another implementation, such devices may themselves include the functionality of the general-purpose computer 270 and operate as the client device 220. For example, the mobile phone 292 or the PDA 293 may include computing and networking capabilities, and may function as a client device 220 by accessing the delivery network 260 and communicating with the host system 210. Furthermore, the client system 205 may include one, some, all, or none of the components and devices described above.

Figure 3:
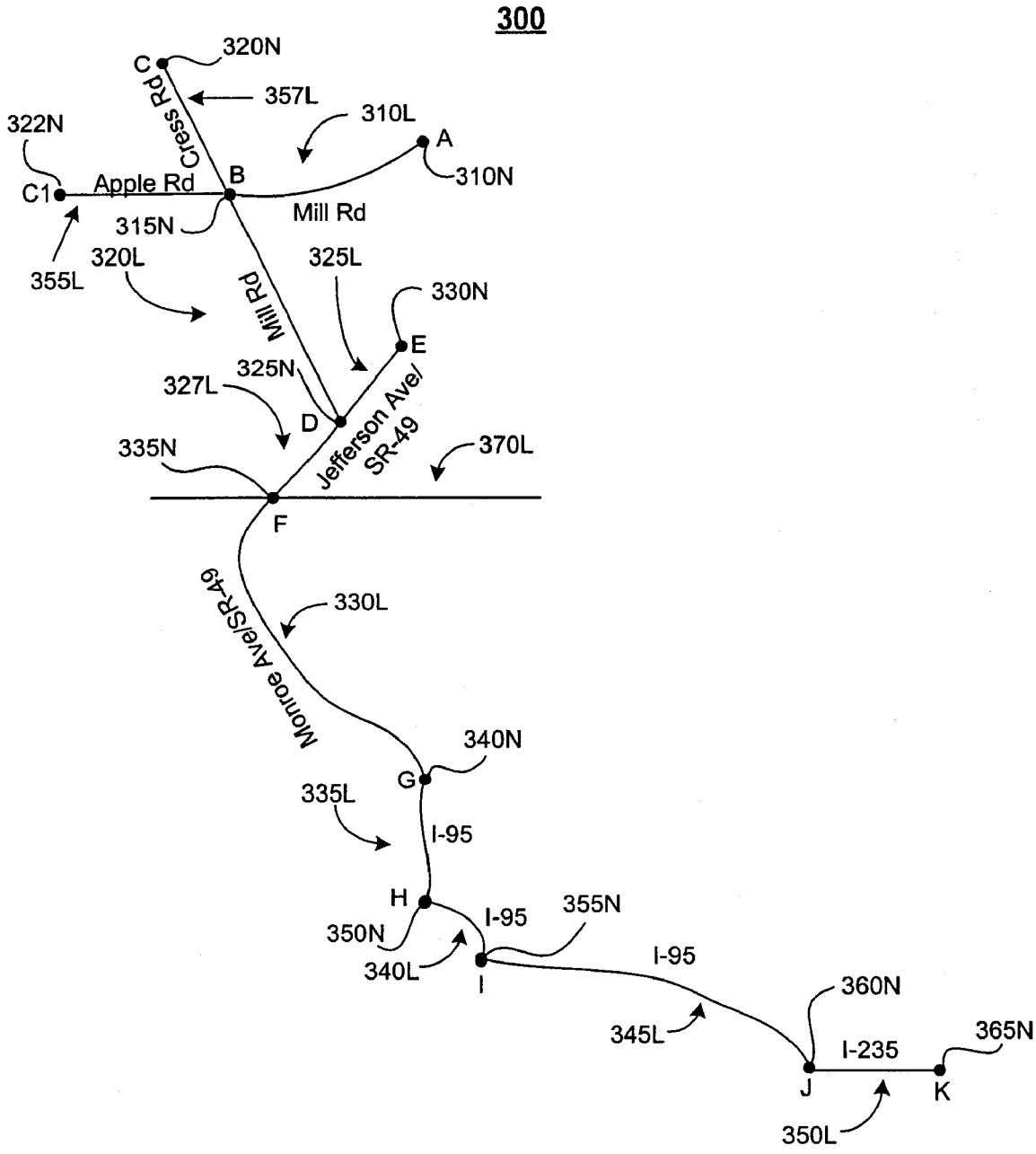
FIGS. 3 and 7 are diagrams of a travel route and a portion of a travel route.

Referring to FIG. 3, a route is shown using routing graph 300. The route extends from an origin location A to a destination location K. The routing graph 300 is illustrated using a collection of links and nodes. A node on the routing graph 300 is represented by a point and is labeled by an uppercase alphabetic character (e.g., A, B, or C). A link on the routing graph 300 is represented by a link that connects two nodes. A link may be referenced using a pair of nodes. For example, the line between node A and node B may be referred to as link AB or as link BA.

The route includes links AB 310L, BD 320L, DF 325L, FG 330L, GH 335L, HI 340L, IJ 345L and JK 350L. The routing graph 300 also includes nodes A 310N, B 315N, C 320N, C1 322N, D 325N, E 330N, F 335N, G 340N, H 350N, I 355N, J 360N and K 365N. The routing graph 300 also includes link BC1 355L, BC 357L and ED 325L that are adjacent to the route but not included in the route. The routing graph 300 also includes a line 370L that presents a regional dividing line separating a region that includes nodes 320N to node 335N and links 310L to 327L from a different region that includes nodes 340N to 365N and links 330L to 350L. For example, the line 370L may separate one county within a state from another county.

Figure 4:
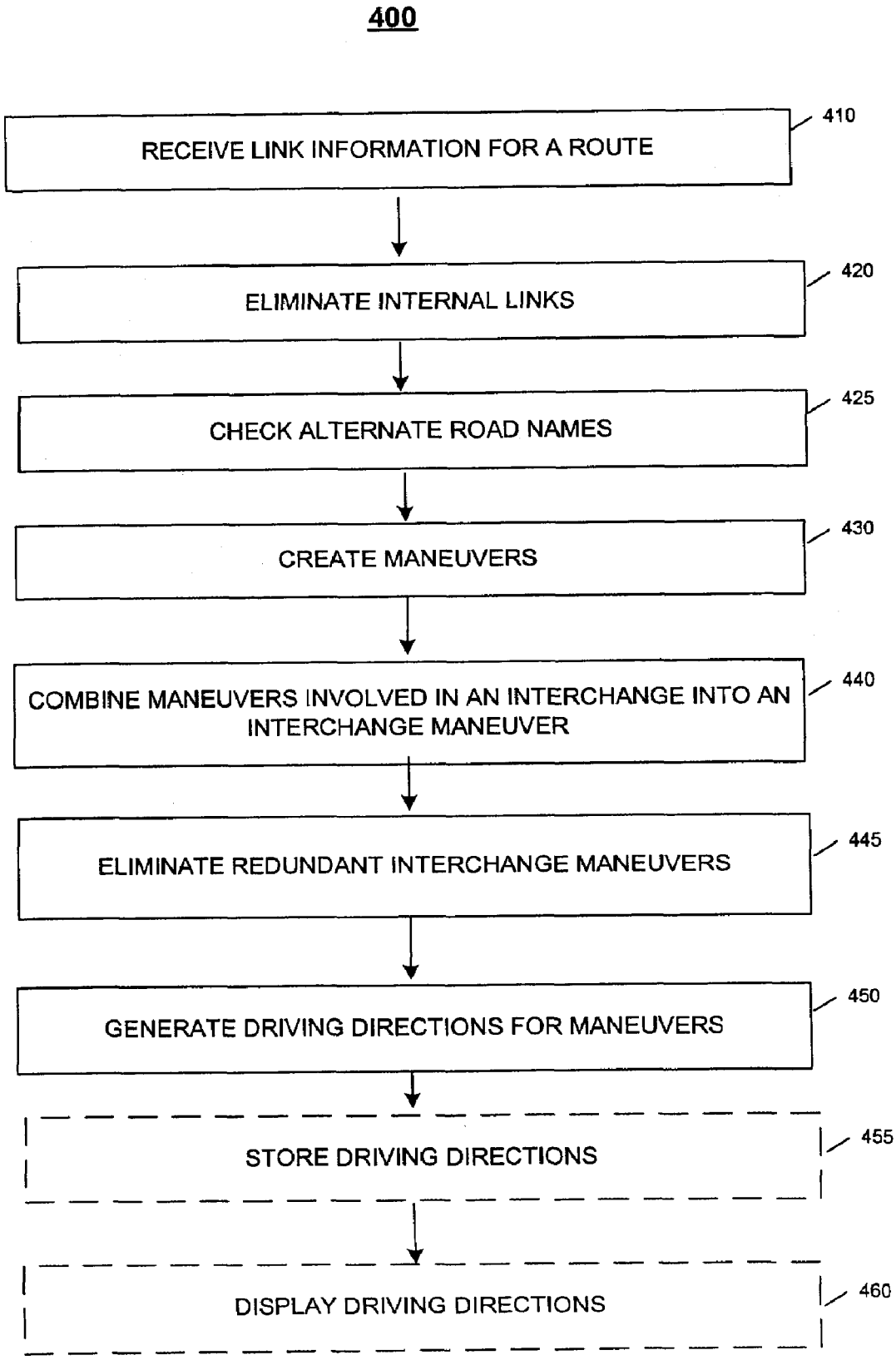

FIG. 4 illustrates a process 400 that may be used to present succinct narrative driving directions. The process may be performed by a mapping system, such as described previously. In general, the mapping system receives information about the links in a route and processes the link information to generate a preliminary list of maneuvers for the route. Typically, the mapping system processes link information by comparing link information for two or more links to determine whether the links may be combined into a single preliminary maneuver and iteratively processing link information until all of the link information has been processed. Then the mapping system processes the preliminary list of maneuvers to generate a list of driving maneuvers, from which the mapping system generates text for succinct driving directions. To do so, the mapping system typically processes two or more preliminary maneuvers to determine whether the preliminary maneuvers may be combined into a single driving maneuver until all of the preliminary maneuvers have been processed. The mapping system then generates text for each of the driving maneuvers to present succinct driving directions.

More specifically, the process 400 begins when the mapping system receives link information for a route (step 410). In one implementation, the mapping system receives a list of links associated with a particular route and, using the list of links, the mapping system accesses link information for the links. In another implementation, the mapping system receives the link information in lieu of a list of links.

Figure 5:
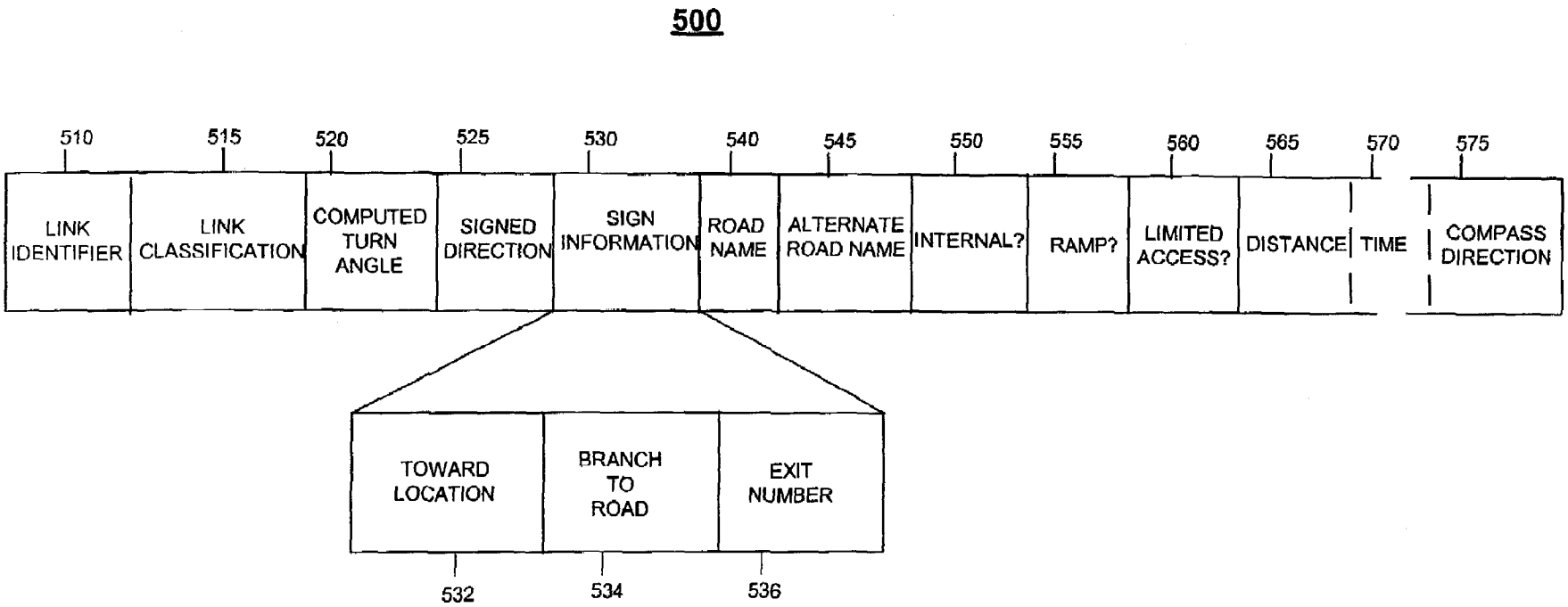
FIG. 5 is a block diagram depicting example data structures used to display link information for a route for which driving directions are presented.

FIG. 5 shows an example of a data structure 500 for link information to illustrate types of link information that may be received by the mapping system. The link data structure 500 includes a link identifier 510, a link classification 515, a computed turn angle 520, a signed direction 525, sign information 530 (which includes a toward-location 532, a branch-to-road 534 and an exit number 536), a road name 540, an alternate road name 545, an internal link indicator 550, a ramp 555 indicator, a limited-access indicator 560, a distance 565, an optional time 570 and a compass direction 575.

The link identifier 510 uniquely identifies a particular link to which the link information applies. The link classification 515 identifies the type of road that corresponds to the link. Examples of the type of road include a fully-controlled limited access highway, a partially-controlled limited access highway, an artery, or a local road.

The computed turn angle 520 indicates the degree of angle involved in a turn from the link to another link in the route. The computed turn angle 520, for example, may be one of a sharp left, a sharp right, a slight left, a slight right, a merge, or straight. The computed turn angle 520 may be determined based the end-node turn degree of the link and the begin-node turn degree of the next link in the route. The computed turn angle 520 may be determined based on dynamic execution of a process to determine a turn angle. The computed turn angle 520 also may be stored in relation to the route for later use.

The signed direction 525 indicates the travel direction of the road that corresponds to the link as indicated by posted signs along the road. A signed direction typically is one of north, south, east or west. Additionally or alternatively, the signed direction 525 may be stored in association with the road name (such as being stored as a suffix to the road name).

The sign information 530 indicates information about one or more exit signs that applies to the link. The sign information includes a toward-location 532 that identifies a city name or road name that occurs along the road to which the exit applies. The sign information also includes a branch-to-road 534 that identifies the road to which the exit applies and an exit number 536 for the exit. Thus, the components 532, 534 and 536 of sign information 530 describe the typical sign information that is shown by an exit sign to a limited-access road. For example, an exit sign indicating that an exit numbered 21A branches to I-95 North toward New York has sign information 530 of a toward-location 532 of "New York," a branch-to-road 534 of "I-95North," and an exit number 536 of "21A." A link may include sign information 530 for more than one sign.

The road name 540 indicates the name of the road that corresponds to the link. Together, the link classification 515, the signed direction 525 and the road name 540 identify a particular road. For example, the particular road name "I-235 South" is identified using a link classification 515 of "Fully-controlled Limited Access Highway," a signed direction 525 of "South" and a road name 540 of "235."

The alternate road name 545 indicates an alternate name of the road when one exists. For example, a road may have both an alphabetical name (such as "Washington Avenue") and a road number assigned by a state highway authority (such as "PA-235") or a national highway authority (such as "Interstate-95"). In some implementations, the alternate road name may include multiple alternative road names.

The internal link indicator 550 identifies whether a link is an internal link. An internal link is a link that occurs at an intersection of doubly-digitized roads. A doubly-digitized road is a two-way road represented as two separate roads. For example, Interstate-95 may be represented as Interstate-95 North and Interstate-95 South. An internal link is described more fully below.

The ramp indicator 555 identifies whether the link corresponds to a ramp of a road.

The limited-access indicator 560 identifies whether the link corresponds to a limited-access road. In one example, an interstate highway is a fully-controlled limited-access road in which access to and from the interstate is through a highway interchange rather than a direct intersection of two roads. A highway interchange may occur with any type of highway that includes exits and ramps. In another example, a road may be a partially-controlled limited-access road when access to and from a road is sometimes controlled through a highway interchange and sometimes not so controlled.

The distance 565 indicates the distance to traverse the link. The optional time 570 identifies an average time for traversing the link. The compass direction 575 identifies the general direction of travel of a vehicle on a road that corresponds to the link. The compass direction 575 may be the same, or different from, the signed direction 525 of the link.

The link information 500 also may include other types of attributes, such as whether a link includes a fork in a road.

Referring again to FIG. 4, the mapping system eliminates internal links in the link information for a route (step 420). In general, the mapping system identifies internal links based on the internal link indicator 550 in the received route information 500, as described above with respect to FIG. 5. The mapping system eliminates the internal link by combining the information about the internal link with information about another link. The mapping system typically combines the link information for the internal link with link information for a previous link or a next link to be included as a maneuver, as described more fully below with respect to FIG. 8.

The mapping system also checks alternate road names of links to identify links that may be combined (step 425). For example, the mapping system may compare whether the road name 540 or the alternative road name 545 of one link is the same as a road name 540 or an alternate road name 545 of an adjacent link. If so, the mapping system determines whether the adjacent link involves a turn, and if not, the mapping system combines the two links, as described more fully below with respect to FIG. 8. When the mapping system determines that the adjacent link involves a turn, the mapping system does not combine the two links.

The mapping system creates maneuvers from the link information (step 430). To do so, the mapping system generates maneuver information based on link information for the one or more links used to generate a particular maneuver. The maneuver information may be substantially similar to link information as described above with respect to FIG. 5. When a link has been combined with one or more other links, the mapping system generates only a single maneuver for the combined link information.

The mapping system combines maneuvers involved in a highway interchange into one maneuver (step 440). The combined maneuver may be referred to as an interchange maneuver. The interchange maneuver may describe entering or exiting a limited access road. The limited access road may be a fully controlled limited-access road or a partially-controlled limited-access road. The combination of maneuvers involved in a highway interchange may be accomplished by identifying maneuvers that have the same sign information 530 and then combining and/or eliminating maneuvers that have same sign information 530, as described more fully below with respect to FIG. 9.

The mapping system eliminates redundant interchange maneuvers (step 445). This may be accomplished, for example, by eliminating an interchange maneuver when the road name or the alternate road name of the maneuver is the same as the previous maneuver, as described more fully below with respect to FIG. 10.

The mapping system generates succinct driving direction text for the maneuvers (step 450). In some implementations, the mapping system generates text that includes the phrase "Continue to follow" and identifies a particular road name or a road number when a maneuver includes multiple road names and the maneuver includes a turn, such as a left turn or a right turn (and not a merge), or when two links that share a road name or an alternate road name have been combined to form the maneuver. One example of such succinct driving direction text is shown in succinct driving direction 613 of FIG. 6 that is described more fully below.

In some implementations, the mapping system generates text that includes the phrase "Merge onto," text associated with a particular road name or road number, and "via" and an exit number and/or exit information. Examples of such succinct driving direction text is shown in succinct driving directions 614 and 615 of FIG. 6.

Optionally, the mapping system stores the succinct driving direction text (step 455). The mapping system also optionally displays the succinct driving directions (step 460). The succinct driving directions may be displayed on a client system display, such as the display 295 of FIG. 2. The succinct driving directions also may be printed on a printer associated with a client system, such as the client system 105 of FIG. 1 or the client system 205 of FIG. 2, or may be displayed on a display associated with an on-board vehicle navigation system.

FIG. 6 depicts an example of succinct driving directions 600 for the route 300. The succinct driving directions 600 includes narrative text 610 for each driving maneuver 611-615 for the route 300. For descriptive convenience, the succinct driving directions 600 also identifies the links 620 that are included in the narrative text 610 for a particular driving maneuver. As is conventional, the mapping system generates the first driving maneuver 611 based on the origin of the route and the last driving maneuver 615 based on the destination.

Figure 7:
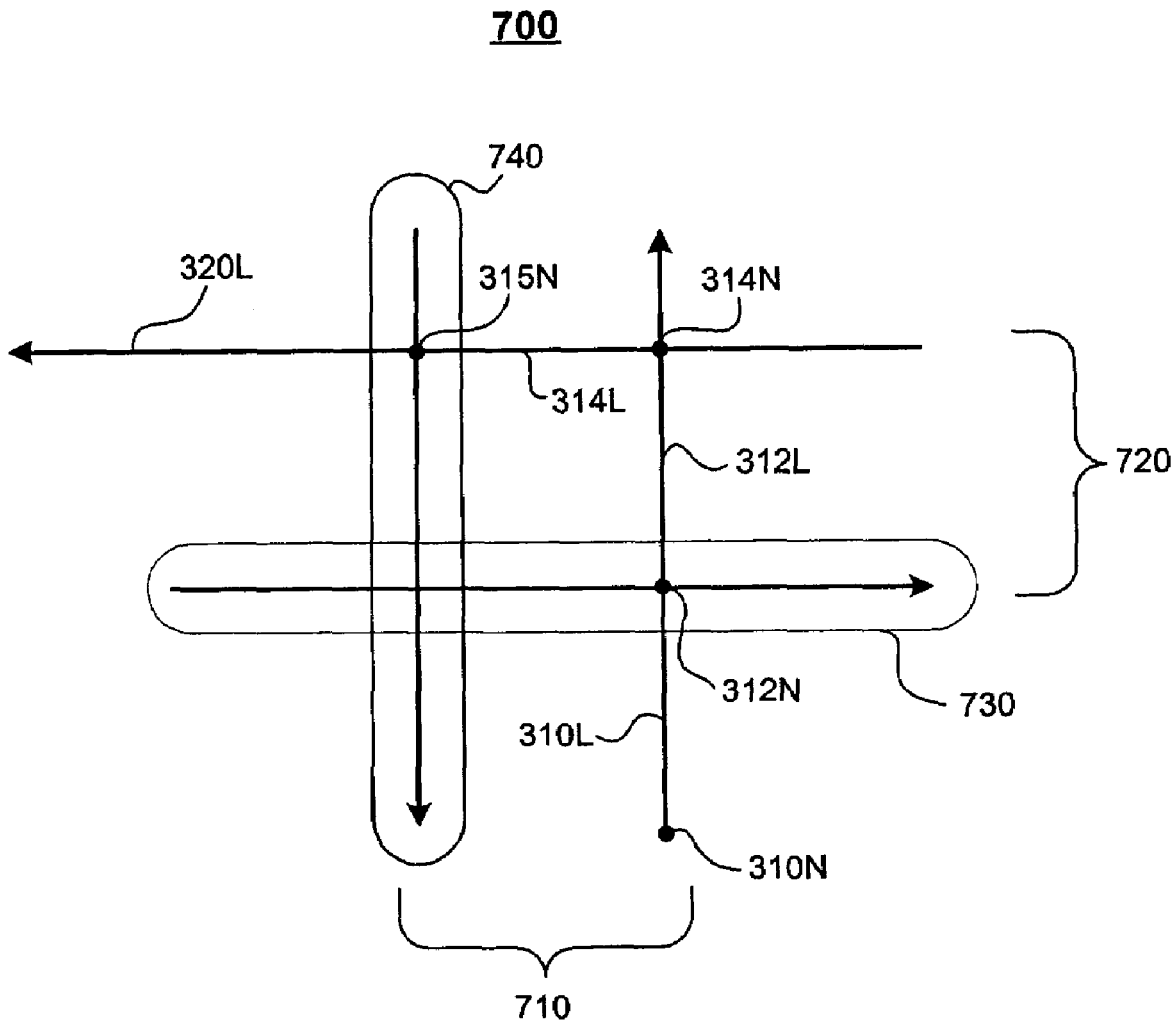

FIG. 7 shows a portion 700 of the route 300. More specifically, the portion 700 illustrates additional detail for the intersection 700 of the link 310L and the link 320L at the node 315N. The intersection 700 is an intersection of two doubly-digitized roads, shown as doubly-digitized road 710 and doubly-digitized road 720. The road 710 includes the link 310L, and the road 720 includes the link 320L. The intersection 700 includes internal links 312L and 314L and internal nodes 312N and 314N. Links 730 for one way of the road 710 are shown, as are links 740 for one way of the road 720.

As shown in FIG. 8, the mapping system eliminates the internal links 312L and 314L, as described previously with respect to steps 420 and 430 of FIG. 4. As also shown in FIG. 8, the mapping system checks road names and appropriately combines links with matching road names (and/or alternate road names) to create a maneuver, as described previously with respect to steps 425 and 430 of FIG. 4.

As an example of eliminating internal links to create a maneuver, the driving maneuver 612 of FIG. 6 results from processing a portion of link information 810 for the links 310L, 312L, 314L and 320L to create maneuver information 820 that includes a maneuver 822 that corresponds to the driving maneuver 612 for the succinct driving directions 600 of FIG. 6 for route 300 of FIG. 3.

The link information 810 includes a portion of link information, such as information about links included in the link data structure 500 of FIG. 5, for each of the links 310L, 312L, 314L and 320L of FIG. 7. The mapping system determines that links 312L and 314L are both internal links based on the internal indicators 550 in link information 810 for these links. The mapping system combines each of the internal links 312L and 314L with the previous link or the next link based on the value of the computed turn angle of the internal link. For example, the mapping system combines the internal link 312L with the previous link 310L in the route based on the computed turn angle 520 of the internal link 312L having a value of "Straight." The mapping system combines the internal link 314L with the next link 320L based on the computed turn angle 520 of the internal link 314L having a value of "Left." As a result, maneuvers 820 include a maneuver 821 that results from combining links 310L and 312L, and a maneuver 822 that results from combining links 314L and 320L.

The maneuvers 820 also includes a maneuver 823 that results from combining links 327L and 330L. While these links represent different road names 540, they share a common alternate road name 545 and, accordingly, may be combined.

Each of the maneuvers 821-823 in the maneuver information 820 includes a maneuver identifier 825, a computed turn angle 830, a road name 835, an alternate road name 840 and a first maneuver indicator 845. The maneuver identifier 825 uniquely identifies a maneuver. In this example implementation, the maneuver identifier 825 identifies the links used to create the maneuver. The maneuver information also includes other information from the information, such as computed turn angle 830, road name 835 and alternate road name 840, for the links that were combined in the maneuver. Also, the maneuver information includes an indication that a particular maneuver (here, maneuver 821) is the first maneuver in the succinct driving directions for a route. As shown, the internal link 312L is combined with the first link 310L in the route to create the first maneuver 821 in the route, and the internal link 314L is combined with the link 320L to create maneuver 822.

By eliminating internal links from maneuvers in the succinct driving directions, the mapping system has created a single maneuver for the left turn at the intersection 600 and has avoided generating driving directions that include multiple maneuvers for the intersection 600.

Some implementations may use another process to eliminate internal links. For example, a mapping system of another implementation may combine links 312L and 314L into a joint internal link, which is then combined with an adjacent non-internal link (such as 320L in this example).

As noted above, FIG. 8 also illustrates an example of having the mapping system check road names and appropriately combine links with matching road names (and/or alternate road names) to create a maneuver, as described previously with respect to steps 425 and 430 of FIG. 4. The driving maneuver 613 of FIG. 6 results from processing a portion of link information 810 for the links 327L and 330L to create a maneuver 823 that corresponds to the driving maneuver 613 for the succinct driving directions 600 of FIG. 6 for route 300 of FIG. 3.

Though the road names 540 for the links 327L ("Jefferson Ave.") and 330L ("Monroe Ave.") do not match, the mapping system determines that the alternate road name 545 ("SR-49") in the link 327L matches the alternate road name 545 ("SR-49") in the link 330L. The mapping system also checks that the computed turn angle 520 of the link 330L is straight, and, since it is, the mapping system combines the links 327L and 330L to create maneuver 823 in maneuver information 820. The mapping system uses the road name 540 of the first of the links 327L and 330L being compared (here, 327L) as the road name 835 of the maneuver 823. The mapping system uses the alternate road name 545 of the link 327L as the alternate road name 840 of the maneuver 823. Using an alphabetical road name as the road name and a state road number (such as "SR-49") as the alternate road name for the maneuver may be useful.

Other implementations may use a different process to determine a road name and an alternative road name for a maneuver. Some implementations may also cross-check the road names and alternate road names of the links being compared—that is, the road name of a particular link is compared both with the road name and the alternate road name of another link and the alternate road name of the particular link also is compared both with the road name and the alternate road name of the other link. The cross-checking of road names and alternate road names may help to reduce the number of driving maneuvers presented in the succinct driving directions.

In some implementations, the mapping system checks whether the intersection of two links that are included in the route and share a road name also includes an intersecting forward link (which is described more fully below). When the intersection of the two route links includes an intersecting forward link, the mapping system does not combine the two route links to create a single maneuver. Instead, the mapping system creates a maneuver for each of the two route links.

To determine whether an intersection of the two route links includes an intersecting forward link, the mapping system compares the computed turn angle of the turn from the first route link to the second route link with a computed turn angle of the turn from the first route link to the non-route link that intersects both route links. When the computed turn angle of the first route link to the non-route link is straight (that is, about 180 degrees) or closer to 180 degrees than the computed turn angle of the first route link and the second route link, the mapping system does not combine the two route links into a single maneuver.

Referring again to FIG. 3, in the example of the two route links 310L and 320L and the non-route link 355L, the route links 310L and 320L both have the road name "Mill Rd.," and the non-route link 355L has a different road name ("Apple Rd."). The computed turn angle from the route link 310L to the route link 320L is a sharp left turn, whereas the computed turn angle from the route link 310L to the non-route link 355L is a straight angle. The mapping system does not combine the two route links 310L and 320L into a single maneuver, even though the road name does not change, because the link 355L is an intersecting forward link with the route links 310L and 320L. Instead, the mapping system creates a maneuver for each of the route links 310L and 320L. By keeping the route links 310L and 320L as separate maneuvers, the mapping system avoids eliminating a necessary maneuver (here, the left turn from the link 310L with the name "Mill Rd." to the link 320L also with the name "Mill Rd."), even though the road name did not change from the previous link.

Figure 9:
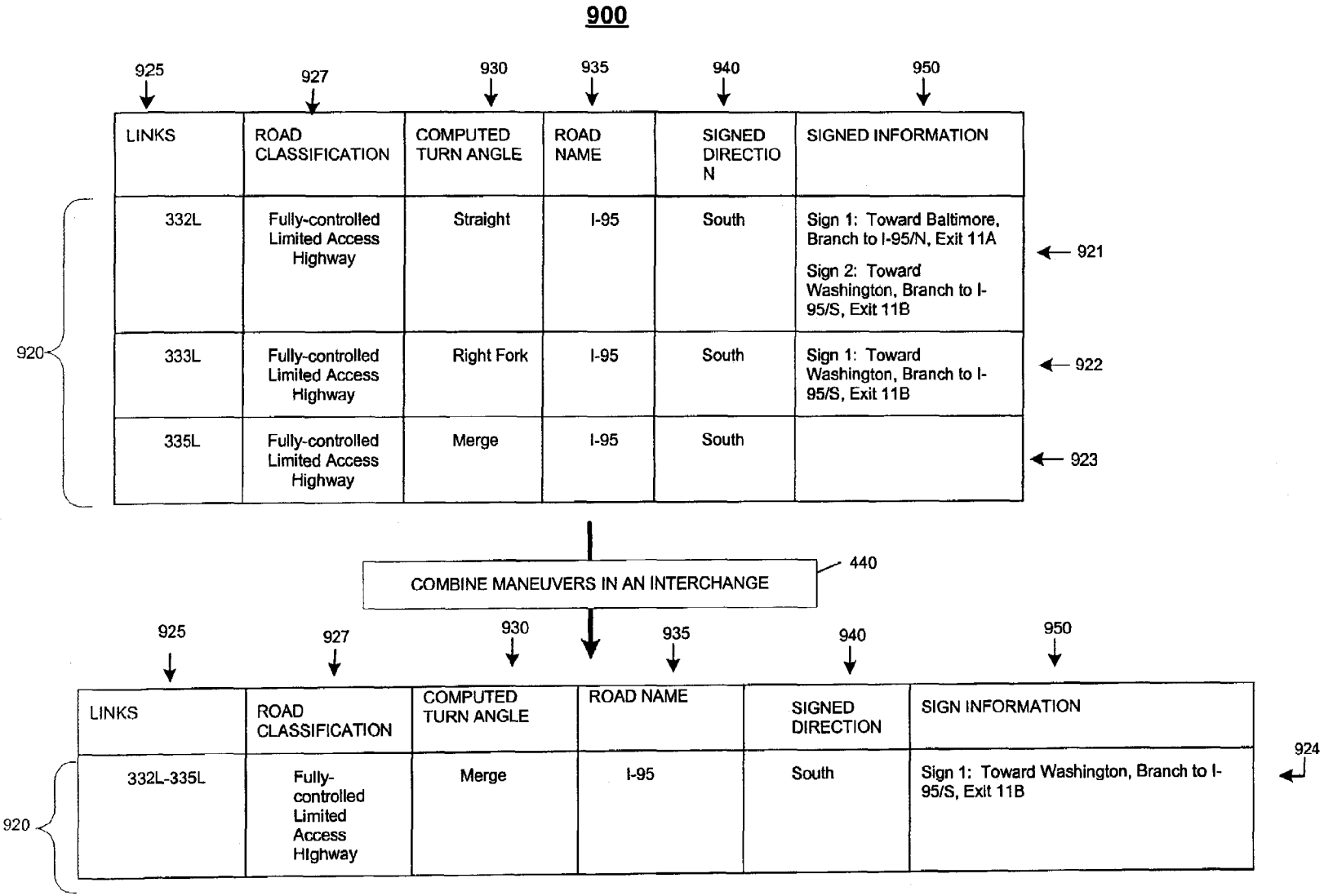

FIG. 9 shows results 900 as one example of a mapping system using maneuver information 920 to combine multiple maneuvers 924-926 into a single interchange maneuver 927, as previously described with respect to step 440 of FIG. 4. The interchange maneuver 927 then is used to help generate the text for a driving maneuver 614 in the succinct driving directions 600 of FIG. 6 for the route 300 of FIG. 3. The maneuver information 920 uses links 925 as a maneuver identifier and also includes a road classification 927 that corresponds to a link classification 515, a computed turn angle 930, a road name 935, a signed direction 940 and signed information 950, all of which correspond to link information for a corresponding link used to create the maneuver. The signed information 950 includes sign information related to one or more signs related to the maneuver, as described previously with respect to elements 530-536 of FIG. 5.

To identify each of the maneuvers as relating to a particular interchange, the mapping system identifies consecutive maneuvers that each have a road classification 927 of "Fully-controlled Limited Access Highway" and which have the same road name 930 (here, "I-95") and signed direction 940 (here, "South") as each of the other maneuvers 921-923 in the particular interchange.

The mapping system checks whether the maneuvers 921-923 can be combined into a single interchange maneuver. To do so, the mapping system determines whether a portion of the signed information 950 for the maneuvers 921-923 match. Here, the signed information 950 for maneuver 921 matches one of the sign portions of the signed information 950 for maneuver 922 (here, "Toward Washington, Branch to I-95/S, Exit 11B" that is identified as "Sign 1" in maneuver 922 and identified as "Sign 2" in maneuver 921). The mapping system combines maneuver 921 and maneuver 922 using the sign information common to both maneuvers 921 and 922 (here, "Toward Washington, Branch to I-95/S, Exit 11B"). The mapping system also determines that the computed turn angle 930 of the maneuver 923 has a value of "Merge" and uses the computed turn angle 930 of maneuver 923 to combine maneuver 923 with the other maneuvers 921 and 922.

The resulting interchange maneuver 924 includes the road classification 927, the road name 921 and the signed direction 940 that is shared by maneuvers 921-923. The interchange maneuver 924 also includes the sign information 940 that is shared by maneuvers 921-922 and the computed turn angle 930 "merge" of maneuver 923.

Some implementations may check to ensure that the road name 935 and signed direction 940 of the interchange maneuver corresponds to the branch-to portion of the sign information 950 of the interchange maneuver. If not, the mapping system determines that an error has occurred in creating the interchange maneuver and does not combine the maneuvers into a single interchange maneuver.

Figure 10:
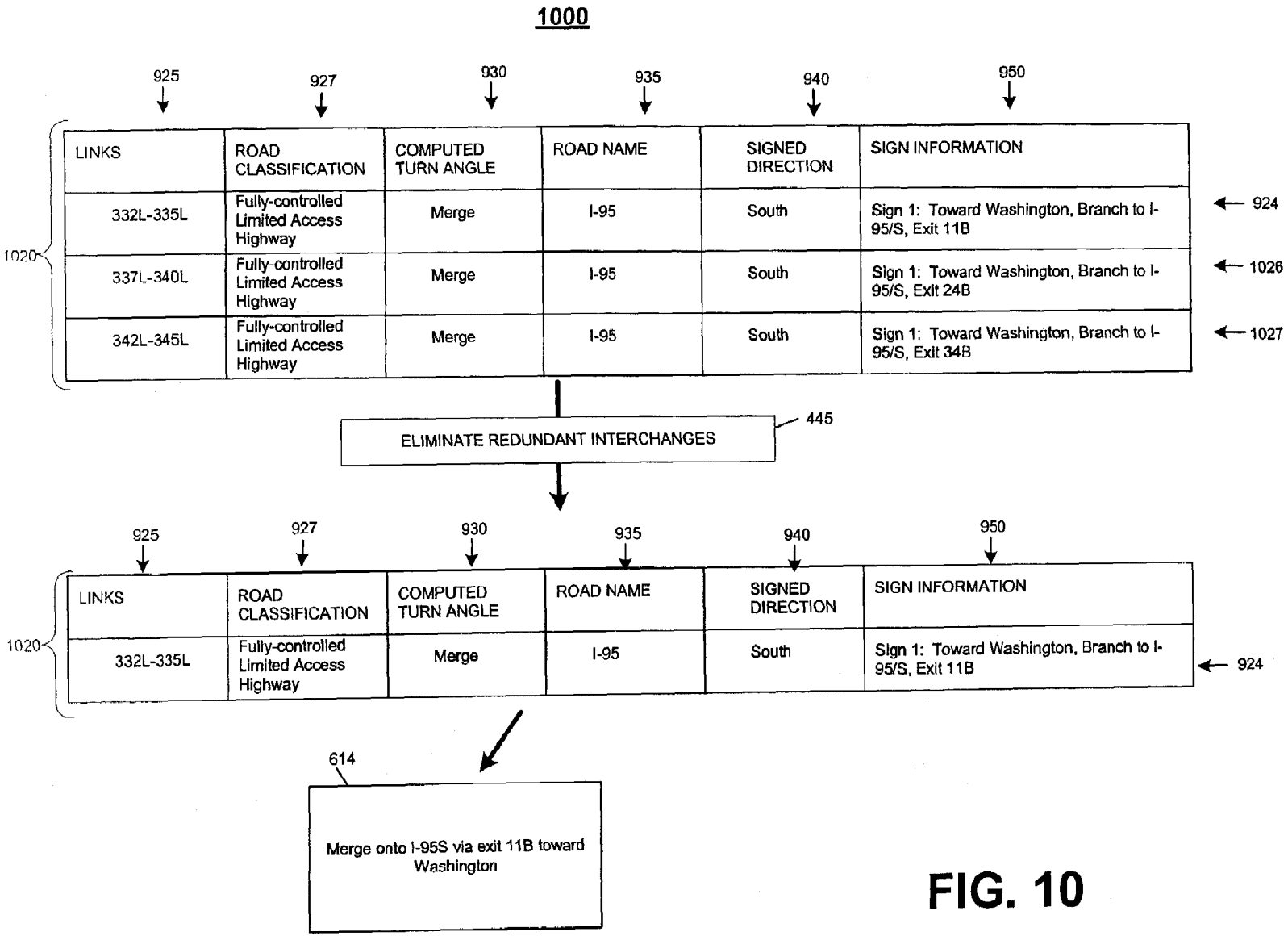

As shown by FIG. 10, multiple maneuvers for an interchange occurring at the link 340L are combined into a single interchange maneuver 1026 and multiple maneuvers for an interchange occurring at the link 345L are combined into a single interchange maneuver 1027, as described previously with respect to step 445 of FIG. 4. The mapping system determines that both of the interchange maneuvers 1026 and 1027 are redundant with the interchange maneuver 924 based on each of the interchange maneuvers 1026 and 1027 having the same values for maneuver attributes 927, 930, 935 and 940 for the interchange maneuver 924. More particularly, the road classification 927 of "Fully-controlled Limited Access Highway," the computed turn angle 930 of "Merge," the road name 935 of "I-95" and the signed direction 940 of "South" are shared by the interchange maneuvers 924, 1026 and 1027.

Although FIGS. 1-10 illustrate systems and methods for displaying driving directions in which route maneuvers are succinct into a fewer number of driving direction maneuvers using a mapping system, the techniques may be applicable, for example, to one or more computing devices for displaying driving directions that communicate in a client system and host system (e.g., an Internet access provider or an Internet service provider) relationship, a single computing device (e.g., with or without networking capabilities), or an embedded system (e.g., a navigation routing system in an automobile or other vehicle).

The techniques and concepts describe processing link information to generate maneuver information and processing the generated maneuver information to generate succinct driving directions. The described techniques and concepts are not limited to being performed only on link information or maneuver information. The techniques described as being performed on link information also may be performed on maneuver information, and the techniques described as being performed on maneuver information also may be performed on link information.

Implementations may include a method or process, an apparatus or system, or computer software on a computer medium. It is intended that various modifications may be made without departing from the spirit and scope of the following claims. For example, advantageous results still could be achieved if steps of the disclosed techniques were performed in a different order and/or if components in the disclosed systems were combined in a different manner and/or replaced or supplemented by other components.

Other implementations are within the following claims.

What is claimed is:

1. A computer-implemented method for displaying driving directions having multiple maneuvers, the method comprising:

accessing maneuver data for a route from an origin to a destination, the maneuver data including maneuvers;

determining whether to combine a first maneuver with a second maneuver based at least in part upon the first maneuver being associated with a highway interchange and the second maneuver being associated with the highway interchange or based at least in part upon the first maneuver including a reference to a particular road; and combining the first maneuver with the second maneuver in response to a determination that the first and second maneuvers should be combined.

2. The method of claim 1 further comprising:

repeating the combining to identify additional interchange maneuvers; and eliminating redundant interchange maneuvers such that a particular highway or a particular interstate is only included in one interchange maneuver for the route.

3. The method of claim 1 wherein combining the first maneuver with the second maneuver includes eliminating internal links.

4. The method of claim 1 wherein determining whether to combine the first maneuver with the second maneuver includes checking alternate road names.

5. The method of claim 1 wherein determining whether to combine the first maneuver with the second maneuver includes checking alternate road names; and determining whether an adjacent link is associated with a turn.

6. The method of claim 5 wherein only if the determination whether the adjacent link is associated with a turn results in a determination that the adjacent link is not associated with a turn, are the first and second maneuvers determined to be combined.

7. The method of claim 1 wherein combining the first maneuver with the second maneuver includes creating a maneuver based at least in part on the first maneuver and the second maneuver.

8. The method of claim 7 wherein combining the first maneuver with the second maneuver includes combining maneuvers involved in a highway interchange into one maneuver.

9. The method of claim 1 further comprising eliminating redundant interchange maneuvers when combining the first maneuver with the second maneuver.

10. The method of claim 9 wherein determining whether to combine the first maneuver with the second maneuver includes checking alternate road names; and eliminating redundant interchange maneuvers includes eliminating an interchange maneuver only if the road name or any alternate road name of the first maneuver is the same as the road name or any alternate road name of the second maneuver.

11. The method of claim 1 wherein determining whether to combine the first maneuver with the second maneuver includes determining whether to combine the first maneuver with the second maneuver based upon the first maneuver being associated with a highway interchange and the second maneuver being associated with the highway interchange.

12. The method of claim 1 wherein determining whether to combine the first maneuver with the second maneuver includes determining whether to combine the first maneuver with the second maneuver based upon the first maneuver including a reference to a particular road.

13. A computer-implemented method for displaying driving directions having multiple maneuvers, the method comprising:

accessing maneuver data for a route from an origin to a destination, the maneuver data including maneuvers;

determining whether to combine a first maneuver with a second maneuver to produce a combined route maneuver based at least in part upon:

the first maneuver including a reference to a particular road, or the first maneuver being associated with a highway interchange and the second maneuver being associated with the highway interchange; and combining the first maneuver with the second maneuver in response to a determination that the first and second maneuvers should be combined.

14. The method of claim 13 wherein determining whether to combine the first maneuver with the second maneuver to produce a combined route maneuver includes determining whether to combine the first maneuver with the second maneuver to produce a combined route maneuver based at least in part upon the first maneuver including a reference to a particular road unless intersection between the first maneuver and the second maneuver includes an intersecting forward link.

15. The method of claim 13 further comprising eliminating internal links either when combining the first maneuver with the second maneuver.

16. The method of claim 13 wherein determining whether to combine the first maneuver with the second maneuver includes checking alternate road names.

17. The method of claim 13 wherein determining whether to combine the first maneuver with the second maneuver includes checking alternate road names; and determining whether an adjacent link is associated with a turn.

18. The method of claim 17 wherein only if the determination whether the adjacent link is associated with a turn results in a determination that the adjacent link is not associated with a turn, are the first and second maneuvers determined to be combined.

19. The method of claim 13 wherein combining the first maneuver with the second maneuver to produce a combined route maneuver includes combining maneuvers involved in a highway interchange into one maneuver.

20. The method of claim 13 further comprising eliminating redundant interchange maneuvers when combining the first maneuver with the second maneuver.

21. The method of claim 20 wherein determining whether to combine the first maneuver with the second maneuver includes checking alternate road names; and eliminating redundant interchange maneuvers includes eliminating an interchange maneuver only if the road name or any alternate road name of the first maneuver is the same as the road name or any alternate road name of the second maneuver.

22. A computer-readable medium having embodied thereon a computer program configured to display driving directions having multiple maneuvers, the medium comprising one or more code segments configured to:

access maneuver data for a route from an origin to a destination, the maneuver data including maneuvers;

determine whether to combine a first maneuver with a second maneuver based at least in part upon the first maneuver being associated with a highway interchange and the second maneuver being associated with the highway interchange or based at least in part upon the first maneuver including a reference to a particular road; and combine the first maneuver with the second maneuver in response to a determination that the first and second maneuvers should be combined.

23. The medium of claim 22 wherein the one or more code segments are further configured to:

repeat the combining to identify additional interchange maneuvers; and eliminate redundant interchange maneuvers such that a particular highway or a particular interstate is only included in one interchange maneuver for the route.

24. A computer-readable medium having embodied thereon a computer program configured to display driving directions having multiple maneuvers, the medium comprising one or more code segments configured to:

access maneuver data for a route from an origin to a destination, the maneuver data including maneuvers;

determine whether to combine a first maneuver with a second maneuver to produce a combined route maneuver based at least in part upon:

the first maneuver including a reference to a particular road, or the first maneuver being associated with a highway interchange and the second maneuver being associated with the highway interchange; and combine the first maneuver with the second maneuver in response to a determination that the first and second maneuvers should be combined.

25. The medium of claim 24 wherein the one or more code segments are configured to determine whether to combine the first maneuver with the second maneuver to produce a combined route maneuver based at least in part upon the first maneuver including a reference to a particular road unless intersection between the first maneuver and the second maneuver includes an intersecting forward link.

26. A system for displaying driving directions having multiple maneuvers, the system comprising a processor connected to a storage device and one or more input/output devices, wherein the processor is configured to:

access maneuver data for a route from an origin to a destination, the maneuver data including maneuvers;

determine whether to combine a first maneuver with a second maneuver based at least in part upon the first maneuver being associated with a highway interchange and the second maneuver being associated with the highway interchange or based at least in part upon the first maneuver including a reference to a particular road; and combine the first maneuver with the second maneuver in response to a determination that the first and second maneuvers should be combined.

27. The system of claim 26 wherein the processor is further configured to:

repeat the combining to identify additional interchange maneuvers; and eliminate redundant interchange maneuvers such that a particular highway or a particular interstate is only included in one interchange maneuver for the route.

28. A system for displaying driving directions having multiple maneuvers, the system comprising a processor connected to a storage device and one or more input/output devices, wherein the processor is configured to:

access maneuver data for a route from an origin to a destination, the maneuver data including maneuvers;

determine whether to combine a first maneuver with a second maneuver to produce a combined route maneuver based at least in part upon:

the first maneuver including a reference to a particular road, or the first maneuver being associated with a highway interchange and the second maneuver being associated with the highway interchange; and combine the first maneuver with the second maneuver in response to a determination that the first and second maneuvers should be combined.

29. The system of claim 28 wherein the processor is configured to determine whether to combine the first maneuver with the second maneuver to produce a combined route maneuver based at least in part upon the first maneuver including a reference to a particular road unless intersection between the first maneuver and the second maneuver includes an intersecting forward link.

* * * * *